US007264492B2

(12) United States Patent
Liang

(10) Patent No.: US 7,264,492 B2
(45) Date of Patent: Sep. 4, 2007

(54) POWER SUPPLY DEVICE WITH REMOVABLE PLUG

(75) Inventor: Jen-Yu Liang, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/306,526

(22) Filed: Dec. 30, 2005

(65) Prior Publication Data

US 2007/0066111 A1 Mar. 22, 2007

(51) Int. Cl.
*H01R 29/00* (2006.01)

(52) U.S. Cl. ..... 439/171; 439/151

(58) Field of Classification Search ..... 439/170–174, 439/217, 221, 151
See application file for complete search history.

(56) References Cited

U.S. PATENT DOCUMENTS 6,087,594 A 7/2000 Chou ..... 174/135
6,942,508 B2 * 9/2005 Wong ..... 439/171

* cited by examiner

*Primary Examiner*—Javaid H. Nasri
(74) *Attorney, Agent, or Firm*—Wei Te Chung

(57) ABSTRACT

A power supply device (10) includes a base (20) and a plug (30). The base includes a square recess (24) and a locating portion (242) positioned in the recess. The plug is removably received in the recess. The plug includes a square main body (32) and a groove (36). The locating portion is received in the groove. The main body can be positioned in the square recess in different orientations.

19 Claims, 5 Drawing Sheets

POWER SUPPLY DEVICE WITH REMOVABLE PLUG

FIELD OF THE INVENTION

The present invention pertains to power supply devices, and particularly to a power supply device with a removable plug.

DESCRIPTION OF RELATED ART

Electronic apparatuses, such as access points, mobile phones, notebooks, and so on, are becoming ever more popular. In these electronic apparatuses, the main function of the power supply device is to supply power to the electronic apparatus, and thus the power supply device is a necessary unit.

Referring to FIG. 5, an isometric view of a conventional power supply device 50 is shown. The power supply device 50 comprises a case 52 and a plug 54 coupled to the case 52. The plug 54 comprises a pair of lead terminals 540, a pair of first contact portions 544, and a pair of cams 542 protruding from opposite sides of a back portion of the plug 54. The lead terminals 540 can be inserted into plug holes of a socket (not shown). The cams 542 are rotatable with-respect to the case 52. The case 52 comprises a pair of second contact portions 520 electrically connected to the first contact portions 544, and a receiving space (not labeled) for receiving the plug 54.

The plug 54, however, may be easily displaced or disengaged from the case 52 when using the power supply device 50. When the plug 54 is forcibly detached from the receiving space of the case 52 during use, lead terminals 540 of the plug 54 may still remain in the socket. When this happens, the first contact portions 544 of the plug 54 may shock a user when the user disengages the plug 54 from the socket and accidentally touches the first contact portions 544 of the plug 54. In addition, since the plug 54 is immovable once the power supply device 50 is plugged into the socket, the power supply device 50 may block adjacent plug holes of the socket whereupon the plug holes cannot be utilized.

Therefore, a heretofore unaddressed need exists in the industry to overcome the aforementioned deficiencies and inadequacies.

SUMMARY OF INVENTION

In an exemplary embodiment, a power supply device includes a base and a plug. The base includes a square recess and a locating portion positioned in the recess. The plug is removably received in the recess. The plug includes a square main body and a groove. The locating portion is received in the groove. The main body can be positioned in the square recess in different orientations.

Other advantages and novel features will become more apparent from the following detailed description of preferred embodiments when taken in conjunction with the accompanying drawings, in which:

DETAILED DESCRIPTION

Figure 1:
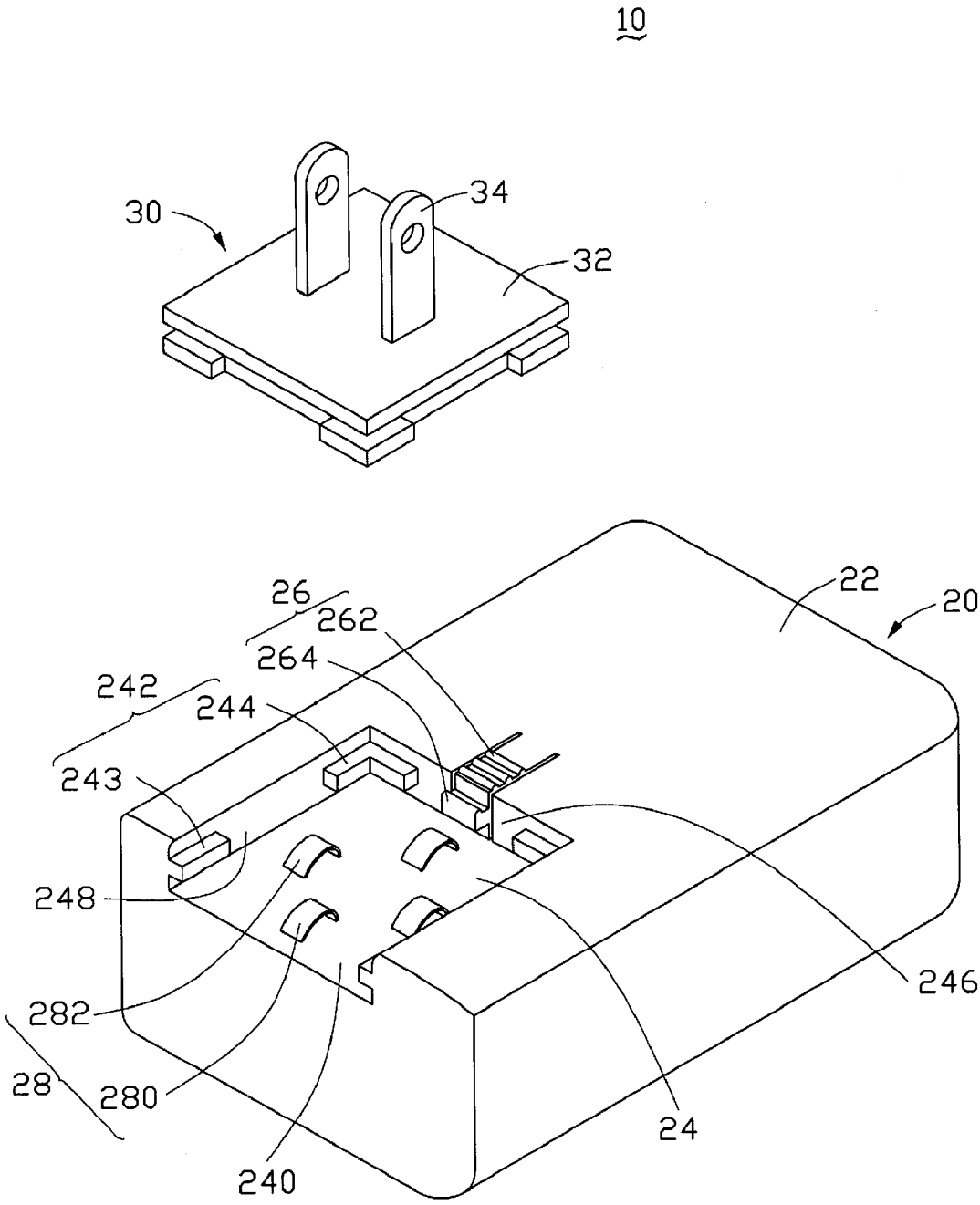
FIG. 1 is an exploded, isometric view of a power supply device of an exemplary embodiment of the present invention, the power supply device includes a base and a plug.

Referring to FIG. 1, a power supply device 10 of an exemplary embodiment of the present invention comprises a base 20 and a plug 30. Note that the power supply device 10 of the invention can be a stand-alone product or a part of another electronic device.

The base 20 comprises a bottom wall 22. A square recess 24 is defined in an end portion of the bottom wall 22. The plug 30 is removably received in the recess 24. The recess 24 is bounded by a pair of opposite first inner walls 248, a second inner wall 246, and a bottom portion 240. The second inner wall 246 is perpendicularly connected to the first inner walls 248. A connecting member 28, disposed in the recess 24, protrudes from the bottom portion 240. The connecting member 28 comprises a pair of first contact portions 280 and a pair of second contact portions 282. The first contact portions 280 are aligned parallel to the first inner walls 248, and the second contact portions 282 are aligned parallel to the second inner wall 246. The base 20 comprises a locating portion 242 protruding from the first inner walls 248 and the second inner wall 246 into the recess 24. A distance between the locating portion 242 and the bottom portion 240 is equal to a distance between the locating portion 242 and an outer surface of the bottom wall 22. The locating portion 242 comprises a pair of first protrusions 243 disposed on opposite sides of the first inner walls 248, and a pair of second protrusions 244 disposed at joints of the second inner wall 246 and the first inner walls 248. Each second protrusion 244 is generally L-shaped. The base 20 further comprises a fixing portion 26 adjacent to the recess 24 and located at the bottom wall 22. The fixing portion 26 comprises a hook 264 and a plurality of ribs 262. The hook 264 is generally disposed on a middle portion of the second inner wall 246, and projects into the recess 24. The ribs 262 are parallel to the second inner wall 246, facilitating operation of the hook 264.

Figure 2:
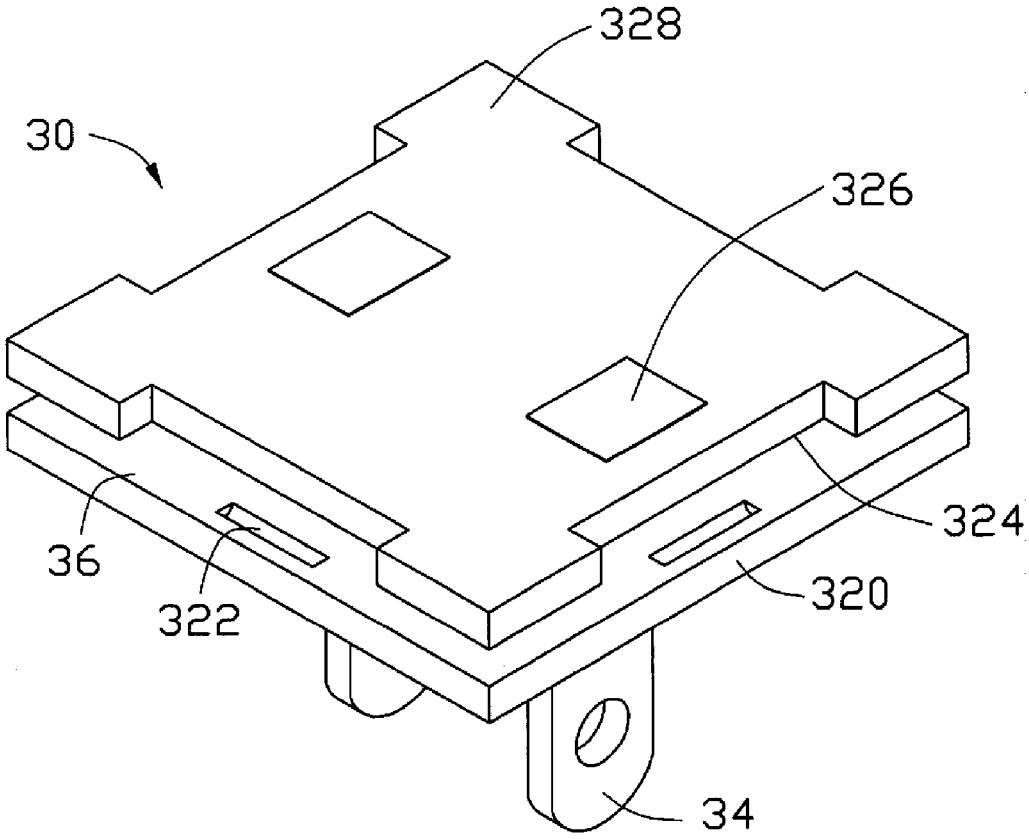
FIG. 2 is an enlarged, inverted, isometric view of the plug of the power supply device of FIG. 1.

Referring also to FIG. 2, the plug 30 comprises a square main body 32, a groove 36, and a pair of conducting terminals 34 disposed on the main body 32. The conducting terminals 34 electrically connect to a socket having a plurality of plug holes (not shown). The main body 32 comprises a top portion 320 and a bottom portion 328, and the groove 36 is defined at a junction between the top portion 320 and the bottom portion 328. A pair of contact portions 326 projects from the bottom portion 328. The contact portions 326 are electrically connected to the conducting terminals 34 and the first contact portions 280 or the second contact portions 282 of the base 20. The top portion 320 defines four receiving slots 322 in an inner face thereof for receiving the hook 264. After assembly, the hook 264 is received in one of the receiving slots 322, and the locating portion 242 is received in the groove 36. A cutout 324 is defined in each of four sides of the bottom portion 328, for facilitating machining the receiving slots 322.

Figure 3:
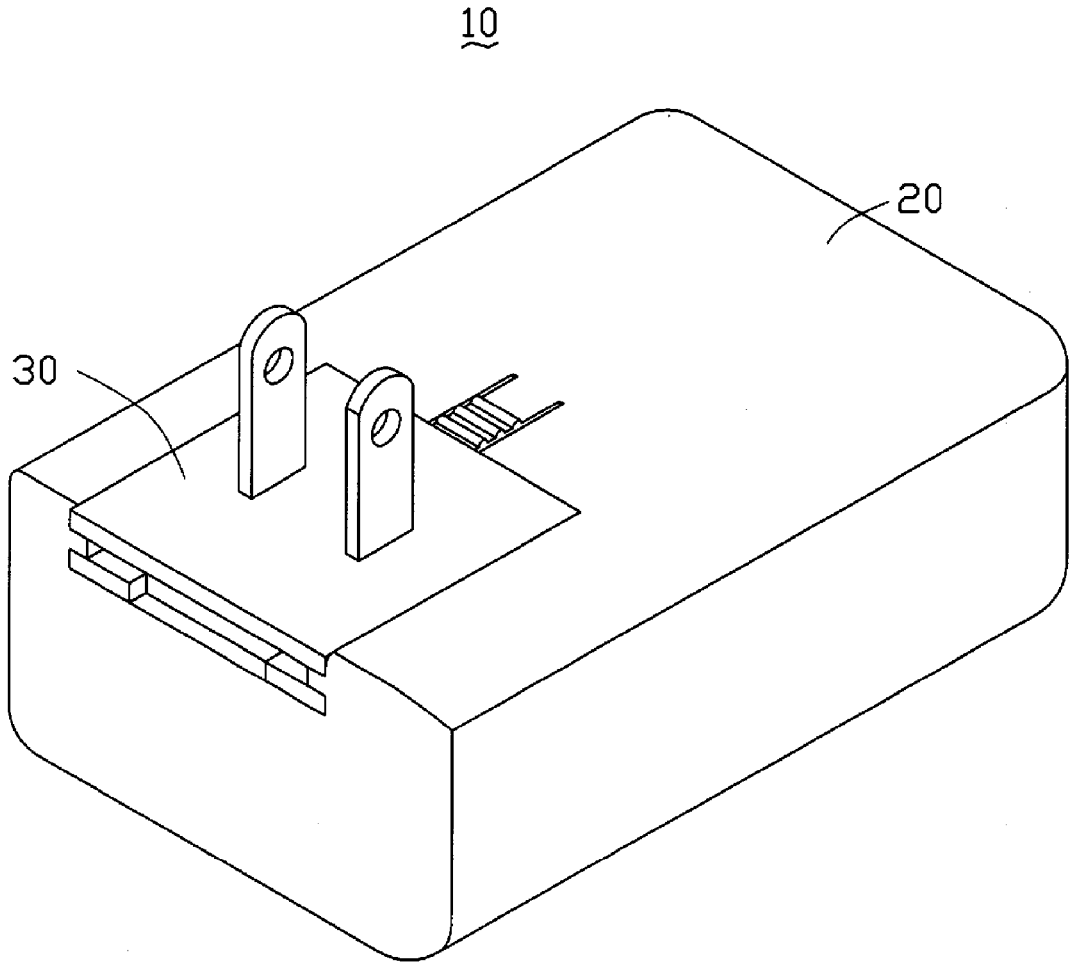
FIG. 3 is an assembled view of FIG. 1.

Referring also FIG. 3, when the plug 30 is assembled with the base 20, the first protrusions 243 and the second protrusions 244 of the base 20 are received in the groove 36 of the plug 30. The hook 264 of the base 20 is received in one of the receiving slots 322. Thus, the plug 30 is mounted to the base 20. When the contact portions 326 of the plug 30 are electrically connected to the first contact portions 280 of the base 20 respectively, the power supply device 10 is in a first position.

During use, the conducting terminals 34 of the plug 30 are inserted into two of the matching plug holes of the socket. If the base 20 of the power supply device 10 blocks the other plug holes of the socket, the plug 30 can be disengaged from the base 20 and rotated 90° or 270° relative to the base 20, then, the plug 30 is reengaged to the base 20. Accordingly, the power supply device 10 is rotated 90° or 270° relative to the socket, and the other plug holes of the socket that were shielded by the base 30 are revealed. After rotation to a second position, the contact portions 326 of the plug 30 are electrically connected to the second contact portions 282 of the base 20, respectively.

Because the hook 264 of the base 20 is securely received in one of the receiving slots 322 of the plug 30, the plug 30 cannot be accidentally detached from the base 30, ensuring proper function of the power supply device 10.

Figure 4:
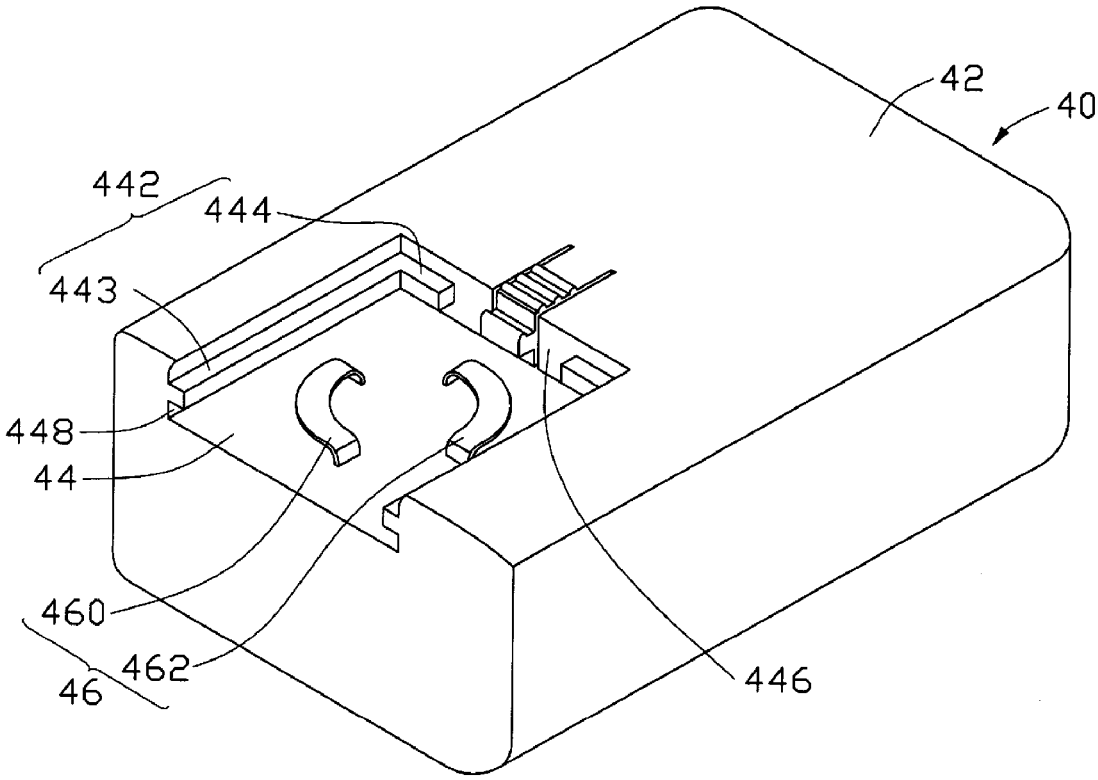
FIG. 4 is an isometric view of a base of a power supply device in accordance with an alternative embodiment.
Figure 5:
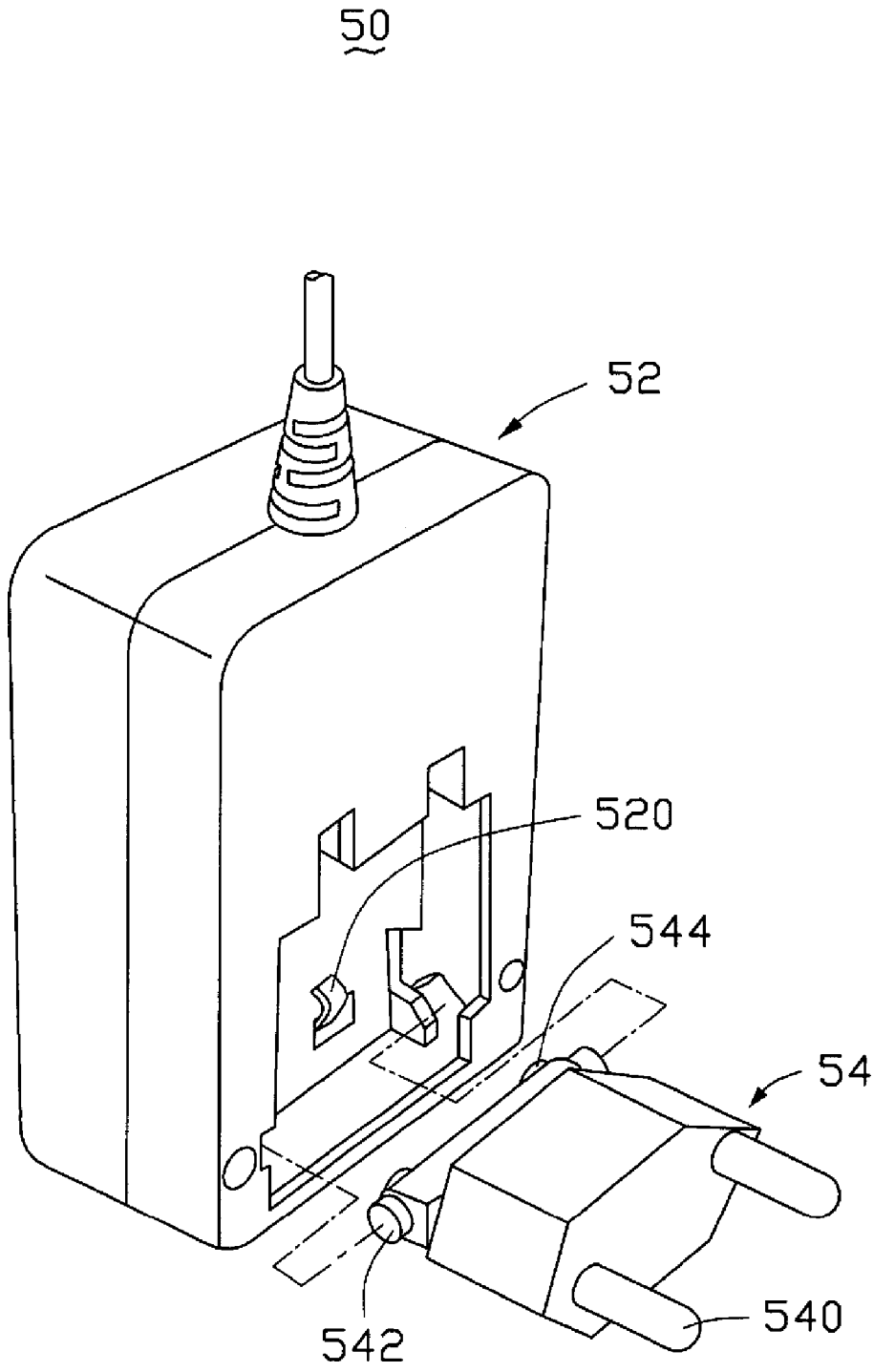
FIG. 5 (PRIOR ART)
FIG. 5 is an exploded, isometric view of a conventional power supply device.

FIG. 4 shows an isometric view of a base 40 of an alternative embodiment. The base 40 has a structure similar to the base 20 as shown in FIG. 1. The base 40 comprises a bottom wall 42 and a square recess 44 defined in an end portion of the bottom wall 42. The recess 44 is bounded by a pair of opposite first inner walls 448, a second inner wall 446, and a bottom portion 440. The second inner wall 446 is perpendicularly connected to the first inner walls 448. The base 40 comprises a locating portion 442 protruding from the first inner walls 448 and the second inner wall 446 into the recess 44. A distance between the locating portion 442 and the bottom portion 440 is equal to a distance between the locating portion 442 and an outer surface of the bottom wall 42. The locating portion 442 comprises a pair of first protrusions 443 disposed on opposite sides of the first inner walls 448, and a pair of second protrusions 444 disposed on the second inner wall 446. A connecting member 46 protrudes from the bottom portion 440 of the recess 44. The connecting member 46 comprises a crescent-shaped first contact portion 460 and a crescent-shaped second contact portion 462. The first and second contact portions 460, 462 are electrically connected to the contact portion 326 after assembly. The base 40 can perform the same function as the base 20.

In an alternative embodiment, the power supply device 10 may be a part of an electronic device, such as a WiFi Repeater. The electronic device comprises a case having same elements and performing the same function as the base 20 or the base 40. That is, the case comprises the elements of the base 20 or 40, and the plug 30 can be mounted to the case of the electronic device.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A power supply device, comprising:

a base comprising a square recess, a locating portion positioned in the recess, and a fixing portion comprising a hook protruding into the recess and a plurality of ribs; and a plug removably received in the recess, the plug comprising a square main body and a groove for receiving the locating portion;

wherein the main body is positioned in the square recess in a selected one of two or more different orientations.

2. The power supply device as claimed in claim 1, wherein the base further comprises a connecting member disposed in the recess, the plug further comprises a pair of contact portions, and the connecting member is electrically connected to the contact portions.

3. The power supply device as claimed in claim 2, wherein the connecting member comprises a first contact portion and a second contact portion, and the first contact portion and the second contact portion are crescent-shaped.

4. The power supply device as claimed in claim 2, wherein the connecting member comprises a pair of first contact portions and a pair of second contact portions; when the power supply device is in a first position, the contact portions of the plug are electrically connected to the first contact portions; when the power supply device is in a second position, the contact portions of the plug are electrically connected to the second contact portions.

5. The power supply device as claimed in claim 1, wherein the base further comprises a bottom wall, the recess is defined in the bottom wall, and the recess is bounded by a pair of first inner walls and a second inner wall perpendicularly connected to the first inner walls.

6. The power supply device as claimed in claim 5, wherein the locating portion comprises a pair of first protrusions disposed on the first inner walls, and a pair of second protrusions disposed at the joins of the second inner wall and the first inner walls.

7. The power supply device as claimed in claim 5, wherein the locating portion comprises a pair of first protrusions disposed on the first inner walls, and a pair of second protrusions disposed on the second inner wall.

8. The power supply device as claimed in claim 1, wherein the plug further comprises at least two receiving slots for receiving the hook.

9. The power supply device as claimed in claim 1, wherein the main body comprises a top portion and a bottom portion, and the groove is positioned between the top portion and the bottom portion.

10. An electronic device, comprising:

a case comprising a square recess, a locating portion positioned in the recess, and a fixing portion comprising a hook protruding into the recess and a plurality of ribs; and a plug removably received in the recess, the plug comprising a square main body and a groove;

wherein the locating portion is received in the groove, and the main body is positioned in the square recess in a selected one of two or more different orientations.

11. The electronic device as claimed in claim 10, wherein the case further comprises a connecting member disposed in the recess, and the plug further comprises a pair of contact portions electrically connected to the connecting member.

12. The electronic device as claimed in claim 11, wherein the connecting member comprises a first contact portion and a second contact portion, and the first contact portion and the second contact portion are crescent-shaped.

13. The electronic device as claimed in claim 11, wherein the connecting member comprises a pair of a first contact portions and a pair of second contact portions; when the electronic device is in a first position, the contact portions of the plug are electrically connected to the first contact portions; and when the electronic device is in a second position, the contact portions of the plug are electrically connected to the second contact portions.

14. The electronic device as claimed in claim 10, wherein the base further comprises a bottom wall, the recess is defined in the bottom wall, and the recess is surrounded by a pair of first inner walls and a second inner wall perpendicularly connected to the first inner walls.

15. The electronic device as claimed in claim 14, wherein the locating portion comprises a pair of first protrusions disposed on the fist inner walls, and a pair of second protrusions disposed at the joins of the second inner wall and the first inner walls.

16. The electronic device as claimed in claim 14, wherein the locating portion comprises a pair of first protrusions disposed on the first inner walls, and a pair of second protrusions disposed on the second inner wall.

17. The electronic device as claimed in claim 10, wherein the plug further comprises at least two receiving slots for receiving the hook.

18. The electronic device as claimed in claim 10, wherein the main body comprises a top portion and a bottom portion, and the groove is positioned between the top portion and the bottom portion.

19. An electronic device, comprising:

a case comprising a square recess, a locating portion positioned in the recess, and a connecting member disposed in the recess, the connecting member comprising a pair of first contact portions and a pair of second contact portions; and a plug removably received in the recess, the plug comprising a square main body positioned in the square recess in a selected one of two or more different orientations, a groove, and a pair of contact portions electrically connected to the connecting member, the locating portion of the case being received in the groove;

wherein when the electronic device is in a first position, the contact portions are electrically connected to the pair of first contact portions; and when the electronic device is in a second position, the contact portions are electrically connected to the pair of second contact portions.

* * * * *